US006513499B2

(12) United States Patent
Kehoe

(10) Patent No.: US 6,513,499 B2
(45) Date of Patent: Feb. 4, 2003

(54) SNAP FUEL RAIL

(75) Inventor: Jon-David Kehoe, Tilbury (CA)

(73) Assignee: Siemens VDO Automotive Inc., Tilbury (CA)

( * ) Notice: Subject to any disclaimer, the term of this patent is extended or adjusted under 35 U.S.C. 154(b) by 3 days.

(21) Appl. No.: 09/799,302

(22) Filed: Mar. 5, 2001

(65) Prior Publication Data

US 2001/0035161 A1 Nov. 1, 2001

Related U.S. Application Data

(60) Provisional application No. 60/197,158, filed on Apr. 13, 2000.

(51) Int. Cl.[7] ..... F02M 55/02
(52) U.S. Cl. ..... 123/456; 123/469
(58) Field of Search ..... 123/456, 468, 123/469, 470, 472

(56) References Cited

U.S. PATENT DOCUMENTS

| | | | | | |
|---|---|---|---|---|---|
| 5,044,338 | A | * | 9/1991 | Shelton | 123/469 |
| 5,682,857 | A | * | 11/1997 | Briggs et al. | 123/456 |
| 5,713,323 | A | * | 2/1998 | Walsh et al. | 123/469 X |
| 5,724,946 | A | * | 3/1998 | Franchitto | 123/470 |
| 6,334,242 | B1 | * | 1/2002 | Scollard et al. | 24/459 |
| 6,340,019 | B1 | * | 1/2002 | Eshelman et al. | 123/469 |

* cited by examiner

*Primary Examiner*—Tony M. Argenbright

(57) ABSTRACT

The fuel rail assembly comprises a fuel conduit, at least one support connected to the conduit, an engine component body, and a resilient connector attaching the support to the engine component body. The resilient connector can be a resilient insert while the engine component body is preferably an air intake manifold. The support may also be a bracket. The fuel rail assembly further includes at least one fuel injector connected to the fuel conduit. The resilient connector, manifold, and fuel conduit are all preferably plastic.

14 Claims, 2 Drawing Sheets

SNAP FUEL RAIL

This application claims priority to Provisional Patent Application Serial No. 60/197,158 filed Apr. 13, 2000.

BACKGROUND OF THE INVENTION

This invention relates to a means of attaching a fuel rail to an engine component.

A fuel rail is a conduit that delivers fuel from the engine's fuel tank system to its fuel injectors and cylinders. There is generally a fuel rail for each bank of fuel injectors and cylinders. For example, an inline six-cylinder engine requires only one fuel rail while a V-6 engine requires two fuel rails.

Due to the proximity of the air intake manifold to the engine, manufacturers generally mount the fuel rail to the manifold. Frequently, such a rail is mounted on the engine's manifold by use of a bracket, rigid screw, and rigid fitting that receives the rigid screw. The rigid fitting is typically formed of a metal, such as brass, and embedded into the plastic manifold by heating the brass fitting to a temperature sufficient to melt the plastic and embed the fitting into the plastic. Each bracket of the fuel rail is then placed over each brass fitting and attached to the fitting by turning the screw for each bracket into each brass fitting.

This manner of attaching the fuel rail to the manifold, however, is time-consuming. Each brass fitting must be heat installed into the manifold and a screw turned into each fitting. Moreover, the use of a metal screw and metal fitting makes the recycling of the plastic from the manifold costly as each metal screw and metal fitting must be removed prior to recovery of the plastic.

A need therefore exists for a means of quickly and conveniently connecting the fuel rail to the manifold while permitting the recycling of the plastic of the manifold.

SUMMARY OF THE INVENTION

In a disclosed embodiment of this invention, the fuel rail assembly comprises a fuel conduit, at least one support connected to the conduit, an engine component body, and a resilient connector attaching the support to the engine component body. The resilient connector can be a resilient insert while the engine component body is preferably an air intake manifold. The support may also be a bracket. The fuel rail assembly further includes at least one fuel injector connected to the fuel conduit. The resilient connector, manifold, and fuel conduit are all preferably plastic.

If a resilient insert is used, then the manifold and support may each have a hole to receive the resilient insert. The hole of the manifold may be on a flange of the manifold. The resilient insert has a non-flexed dimension greater than the hole and a flexed dimension smaller than the hole.

Preferably, the fuel rail assembly is attached by first inserting the resilient insert into a hole in a flange of the manifold. The insert is then vibration welding into place. The support, either molded as part of the fuel conduit or assembled with the conduit, receives the resilient insert through its hole. Because the resilient insert has non-flexed dimension greater than the hole of the flange and the support, the insert must be forced through the hole with sufficient force to reduce the insert to its flexed dimension, which is smaller than the hole. The assembly is thus "snapped" into place. Once in place, the insert expands locking the bracket and conduit into place.

In this way, the fuel rail assembly may be quickly attached to the engine's manifold. No brass fitting need be embedded into the manifold and no screw is required. Moreover, because the insert, bracket, fuel rail, and manifold are all polymer, they may be all recycled together.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
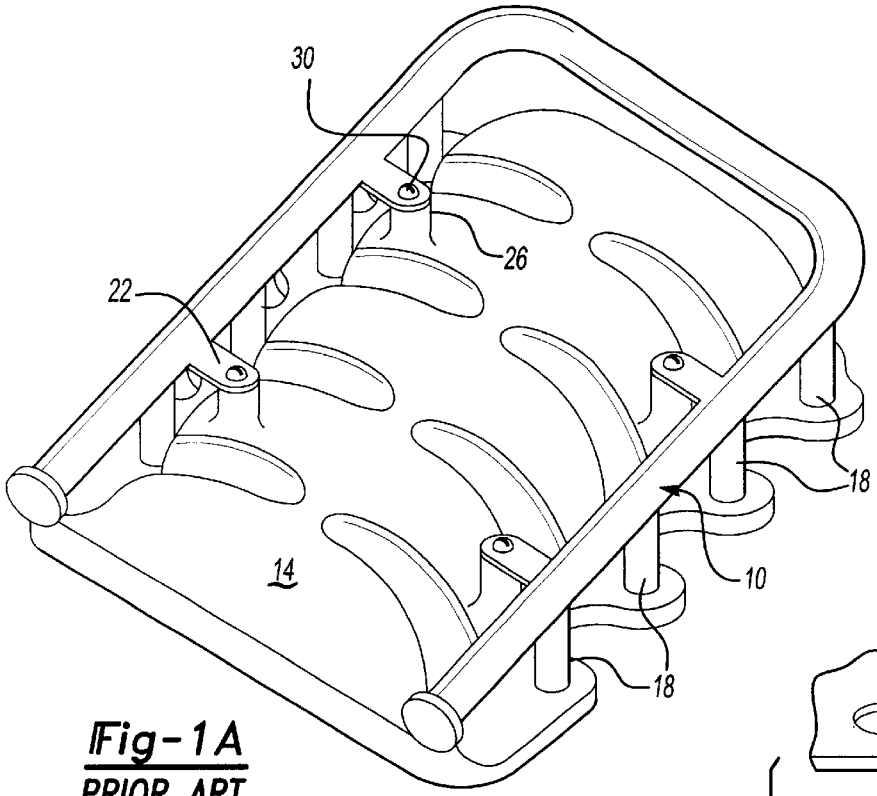
Fig-1A PRIOR ART
FIG. 1A shows a fuel rail assembly as known in the art.
Figure 1B:
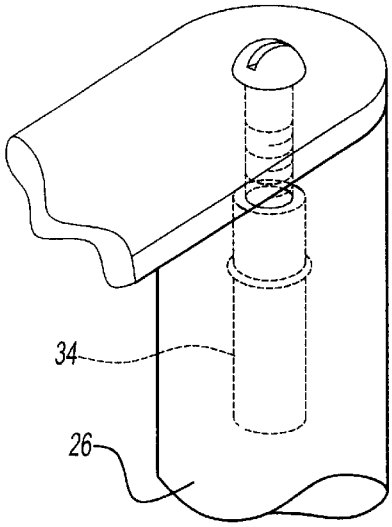
Fig-1B PRIOR ART
FIG. 1B shows a detail view of a portion of the fuel rail assembly of FIG. 1A.

FIG. 1A shows a fuel rail assembly known in the art. Fuel conduit 10 is mounted to manifold 14. Fuel injectors 18 serve to inject fuel into the engine's cylinders from fuel conduit 10. A tab 22, here shown as molded to fuel conduit 10, permits the attachment of fuel conduit 10 to post 26 through brass screw 30. Post 26 is also molded to manifold 14. Embedded within post 26 is brass fitting to receive brass screw 30. As seen in FIG. 1B, brass fitting 34 is within post 26.

Figure 2:
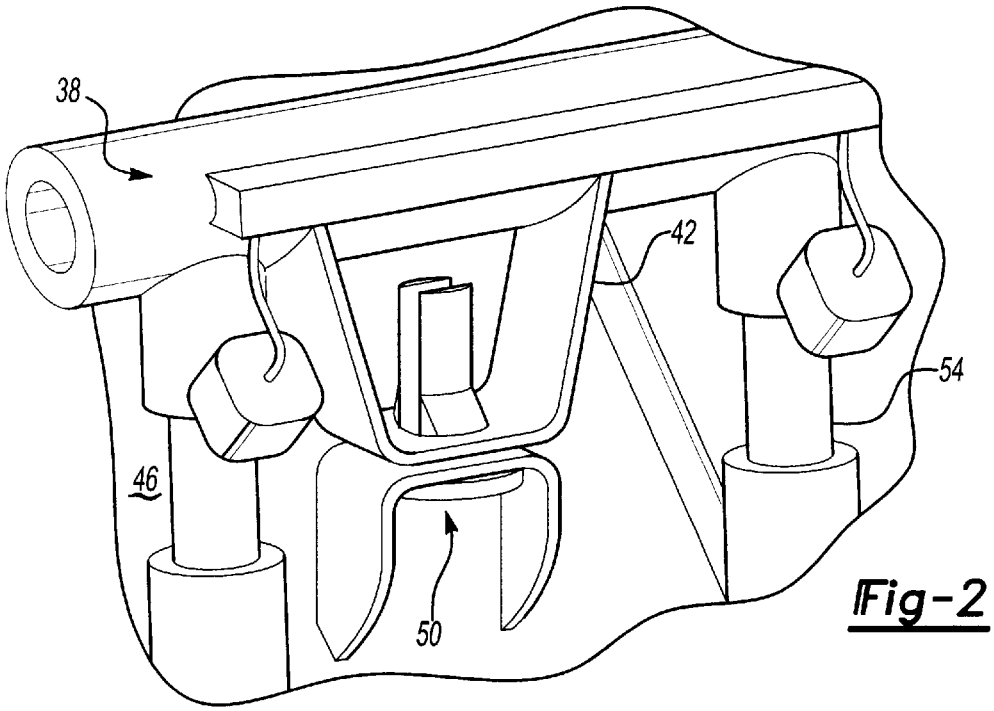
FIG. 2 shows an embodiment of the invention on a manifold.

FIG. 2 shows an embodiment of the invention. The fuel rail assembly comprises fuel conduit 38, at least one support 42 operatively connected to fuel conduit 38, engine component body 46, and resilient connector 50 operatively attaching the support 42 to the engine component body 46. It is preferred that at least two supports are used for each fuel conduit. Fuel conduit 38 delivers fuel to engine cylinders through at least one fuel injector 54. As pictured, engine component body 46 is preferably an air intake manifold. Fuel conduit 38, support 42, resilient connector 50 are preferably a recyclable polymer such as plastic to permit recovery of this material in the recycling process.

Figure 3:
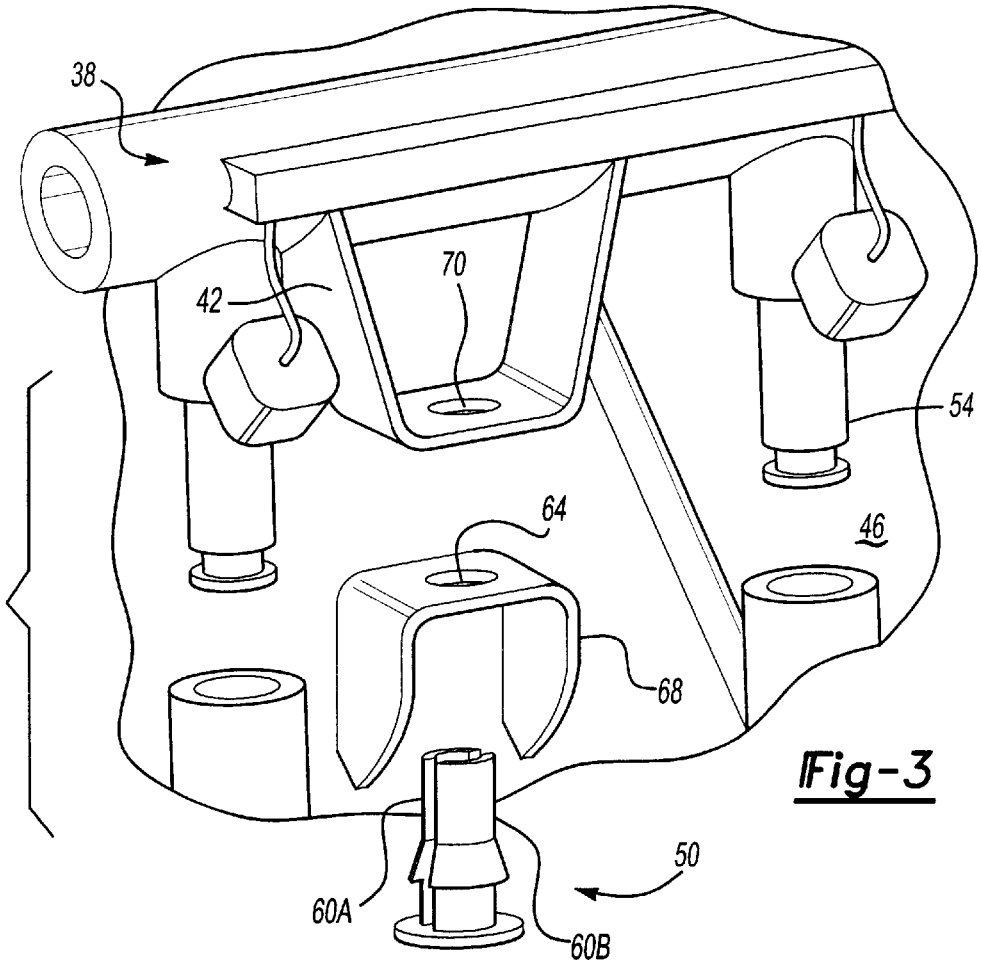
FIG. 3 shows an exploded view of the embodiment of FIG. 2.

FIG. 3 shows an exploded view of the embodiment of FIG. 2. Shown are fuel conduit 38, at least one support 42, engine component body 46, resilient connector 50, and fuel injector 54. Here, resilient connector 50 is more clearly shown as a resilient insert with two legs 60A and 60B beneath hole 64 in manifold 46, which is located on flange 68, molded as part of manifold 46. Other forms of resilient connectors may be developed by one of ordinary skill in the art. Support 42, shown here as bracket, also has a hole 70.

Figure 4:
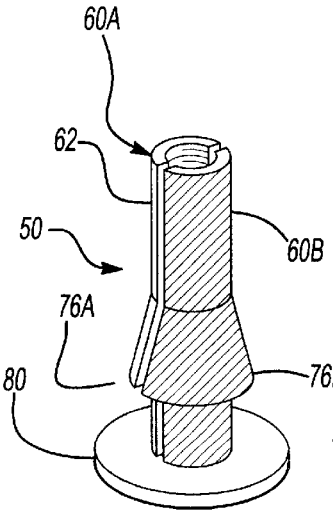
FIG. 4 shows the resilient connector of FIGS. 2 and 3.
Figure 5:
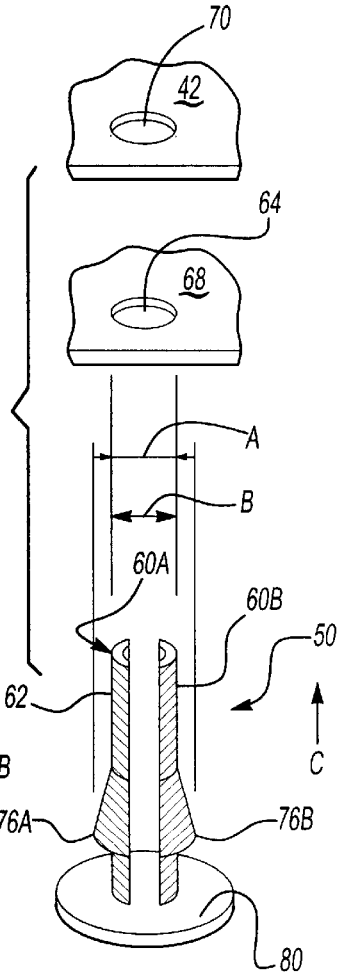
FIG. 5 shows a side view of the resilient connector of FIGS. 2, 3, and 4.

FIGS. 4 and 5 show a detailed view of resilient insert 50. Resilient insert 50 is made of a resilient material such as a polymer like plastic although an individual with ordinary skill in the art may employ other resilient materials. Here, resilient insert 50 has insert portion 62 (shown by shading) comprising leg 60A and leg 60B and lip 76A and lip 76B. Base 80 (not shaded) mounts legs 60A and 60B together. As seen in FIG. 5, lips 76A and 76B of resilient insert 50 have non-flexed dimension A in a relaxed state, greater than the inner dimension of holes 64 and 70. In an inwardly flexed position a dimension B (the outer dimension of both legs) is smaller than the inner dimension of holes 64 and 70.

As can be seen from FIG. 5, resilient insert 50 is inserted in hole 64 in the direction of arrow C. As insert portion 62 of resilient insert 50 is passed through hole 64. Contact between lips 76A and 76B and flange 64 forces lips 76A and 76B and thus legs 60A and 60B inwardly to a distance B and permits insertion of insert portion 62 of resilient insert 50 into holes 64 in direction C beyond lips 76A and 76B. Resilient insert 50 insert is then vibration welding into place on flange 68. Hole 70 of bracket 42 is then placed over the vibration welded resilient insert 50 and forced in a direction opposite of arrow C over insert portion 62 of resilient insert 50. As insert portion 62 of resilient insert 50 passes through hole 70, contact with lips 76A and 76B forces the lips to distance B and permits insertion of resilient insert 50 into hole 70 beyond lips 76A and 76B. Once lips 76A and 76B pass through hole 70, resilient insert 50 expands to distance A, thereby locking support 70 and flange 64 together. Of course, the insert 5 could be formed with body 46 when molded, but is preferably separate.

The aforementioned description is exemplary rather then limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. An assembly comprising:

a fuel conduit;

at least one support operatively connected to said fuel conduit;

an engine component body; and a resilient connector operatively attaching said at least one support to said engine component body wherein said resilient connector is vibration welded to said engine component body.

2. An assembly comprising:

a fuel conduit;

at least one support operatively connected to said fuel conduit;

an engine component body; and a resilient connector operatively attaching said at least one support to said engine component body wherein said resilient connector is a resilient insert with an insert portion.

3. The assembly of claim 2 wherein said component body and said support each have a hole to receive said insert portion.

4. The assembly of claim 3 wherein said insert portion has a non-flexed dimension greater than an inner dimension of said holes and a flexed dimension smaller than said inner dimension of said holes.

5. An assembly comprising:

a fuel conduit;

at least one support operatively connected to said fuel conduit;

an engine component body; and a resilient connector operatively attaching said at least one support to said engine component body wherein said engine component body has a flange operatively connecting said resilient insert to a manifold.

6. An assembly comprising:

a fuel conduit;

at least one support operatively connected to said fuel conduit;

an engine component body; and a resilient connector operatively attaching said at least one support to said engine component body wherein said resilient connector is formed from a polymer.

7. An assembly comprising:

a fuel conduit;

at least one support operatively connected to said fuel conduit;

an engine component body, and a resilient connector operatively attaching said at least one support to said engine component body wherein said engine component body is formed from a polymer.

8. A fuel rail assembly comprising:

a fuel conduit;

at least one support operatively connected to said fuel conduit;

a manifold; and a separate resilient insert with an insert portion operatively connecting said at least one support to said manifold.

9. The fuel rail assembly of claim 8 wherein said manifold and said support each have a hole to receive said insert portion.

10. The fuel rail assembly of claim 9 wherein said insert portion has a non-flexed dimension greater than an inner dimension of said holes and a flexed dimension smaller than said inner dimension of said holes.

11. The fuel rail assembly of claim 8 wherein said support is a bracket.

12. The fuel rail assembly of claim 8 wherein said manifold has a flange operatively connecting said resilient insert to said manifold.

13. The fuel rail assembly of claim 8 wherein said manifold, said resilient insert, and said support are a polymer.

14. The fuel rail assembly of claim 8 further including at least one fuel injector connected to said fuel rail.

* * * * *